US006889391B1

(12) United States Patent
Hitchins

(10) Patent No.: US 6,889,391 B1
(45) Date of Patent: May 10, 2005

(54) SAFETY VISOR

(76) Inventor: Chad Thomas Hitchins, 9 Jamieson La., Beachburg (CA), K0J 1C0

( * ) Notice: Subject to any disclaimer, the term of this patent is extended or adjusted under 35 U.S.C. 154(b) by 0 days.

(21) Appl. No.: 10/793,868

(22) Filed: Mar. 8, 2004

(51) Int. Cl.[7] ..... A42B 1/24
(52) U.S. Cl. ..... 2/422; 2/12; 2/175.6; 2/200.1
(58) Field of Search ..... 2/422, 12, 171.1, 2/175.3, 175.6, 10, 208, 195.7, 200.1, 200.2

(56) References Cited

U.S. PATENT DOCUMENTS 3,337,877 A * 8/1967 Lipkin ..... 2/172
4,246,659 A * 1/1981 Lyons ..... 2/209.3
4,316,289 A * 2/1982 Hild ..... 2/10
4,335,471 A * 6/1982 Quigley et al. ..... 2/12
4,747,164 A * 5/1988 Foulke ..... 2/209.3
4,771,477 A * 9/1988 Cahill ..... 2/12
4,964,171 A * 10/1990 Landis ..... 2/9
5,083,317 A * 1/1992 DeMoreta ..... 2/174
5,406,645 A * 4/1995 Lin ..... 2/10
5,621,915 A * 4/1997 Schneider et al. ..... 2/10
5,727,250 A * 3/1998 Black ..... 2/10
5,768,715 A * 6/1998 Gregg et al. ..... 2/411
5,862,520 A * 1/1999 Wyant ..... 2/10
6,260,204 B1 * 7/2001 Morrissey ..... 2/172
6,436,529 B1 * 8/2002 Deeb et al. ..... 428/354

FOREIGN PATENT DOCUMENTS

WO WO 9102468 A1 * 3/1991 ..... A42B/1/18

* cited by examiner

*Primary Examiner*—Rodney M. Lindsey
(74) *Attorney, Agent, or Firm*—D. W. Eggins; D. Eggins

(57) ABSTRACT

An elastic visor for detachable mounting on headwear is of sheet neoprene having a reinforcing layer of nylon, with a crown aperture that is stretched around, and grips the surface of a headwear to which it is mounted. The neoprene, of about five millimeter thickness, serves to grip the surface of the headwear. The flexible material of the visor permits the peak to deflect under the application of undue force. Ear-protective side flaps and an extended protective neck-flap portion can be incorporated. Decorative crown cut-outs are silhouetted against the helmet.

12 Claims, 5 Drawing Sheets

SAFETY VISOR

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention is directed to a safety visor, having particular use with helmets of varying types, and in particular to a removable helmet visor.

In the past widespread use has been made of visors as an add-on to various types of helmet. These have usually been adhered to the front of a helmet, to form a substantially permanent visor. Such visors are frequently made of stiff material, so that due to the curved form of the visor surface, this constitutes a very rigid structure, serving as a forward extension of the helmet to which it is glued. This forwardly projecting, stiff and rigid structure may in some circumstances constitute a danger to the wearer, or to a third party who comes into contact with the forward edge of the visor.

In instances where the helmet is securely strapped to the head of the wearer, the front edge of the stiff visor may serve as a long lever, by which undue upward and rearward force may be applied to the head and neck of the wearer.

In the case of visors that are used with sportswear helmets, the glued attachment makes removal of the visor a difficult procedure, frequently leaving the helmet badly marked, so that visor replacement may prove time consuming and difficult to carry out.

BRIEF SUMMARY OF THE INVENTION

The present invention provides a self-adhering visor of pliable sheet material.

The primary purpose of the visor is to protect the face, eyes, ears, and back of the neck of a wearer from the sun and rain and also to protect the ears of a wearer from the sun, wind, rain and blasts of water, which is a very common problem in water sports.

It has been found that sheet neoprene rubber, having netting reinforcement, can be readily cut in outline, and having an interior cut-out of predetermined size and shape, will adhere as headgear, while forming a visor with a forward projecting, downwardly curved concave shape.

When applied over the crown of a helmet, the neoprene surface provides strong adherence to the surface of the helmet. However, the visor can be readily removed from the helmet, leaving the surfaces of the helmet unmarked and undamaged.

In use, the forward brim of the visor per se presents a flexible edge that readily deflects when force is applied against it.

In the case of a canoer's helmet that is subject to being submerged, when under-water manoevers are performed, it has been found that the application of water forces against the head of a wearer, which in a normal course of events with an orthodox visor would apply considerable backward leverage to the user's head to the point of extreme danger, instead causes the subject visor to deform by elastically reversing and 'flipping' up in substantially streamlined relation on the front of the helmet, thus avoiding the application of undue and sustained forces against the head and neck of the wearer.

It appears that it is the neoprene rubber surface which provides the unusual "stiction" characteristic to the visor, by the manner in which the tensioned rubber surface adheres quite tenaciously to the outer surfaces of a helmet, even when immersed in turbulent water.

In one embodiment, the neoprene surface is smooth; while in a second embodiment, the surface of the neoprene is embossed with raised areas. The obverse face of the visor material has a thin layer of stretchable nylon material bonded thereto. This nylon material may be in a variety of colours.

A tropical embodiment is contemplated wherein an extended rearward flap is provided for protection of the neck of a user against sun-burn.

The subject visor is preferably cut out of sheet neoprene, having an internal recess through which the crown of the helmet protrudes.

The interior edge of the recess can be cut to a predetermined design, such as a plurality of "shark-teeth", which then display in profile against the sides of the helmet.

Other decorative motifs can be readily adopted, either into the shape of the blanking die, or by embossing or imprinting onto the surface of the visor "ring" which secures the visor in place. This can include safety or promotional information.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figure 1:
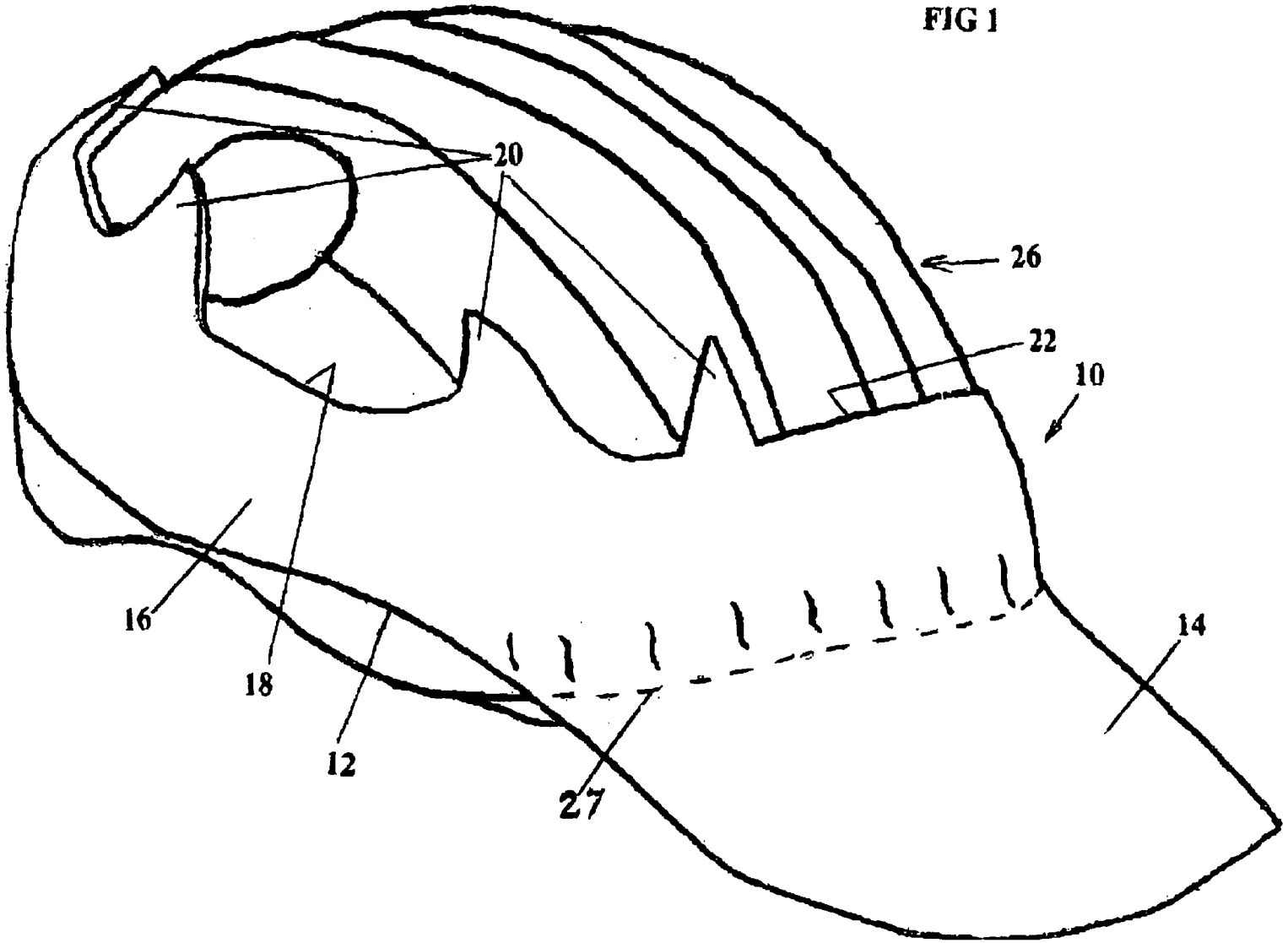
FIG. 1 is a perspective side view of a first embodiment of the subject visor in attached relation on a sports safety helmet.
Figure 2:
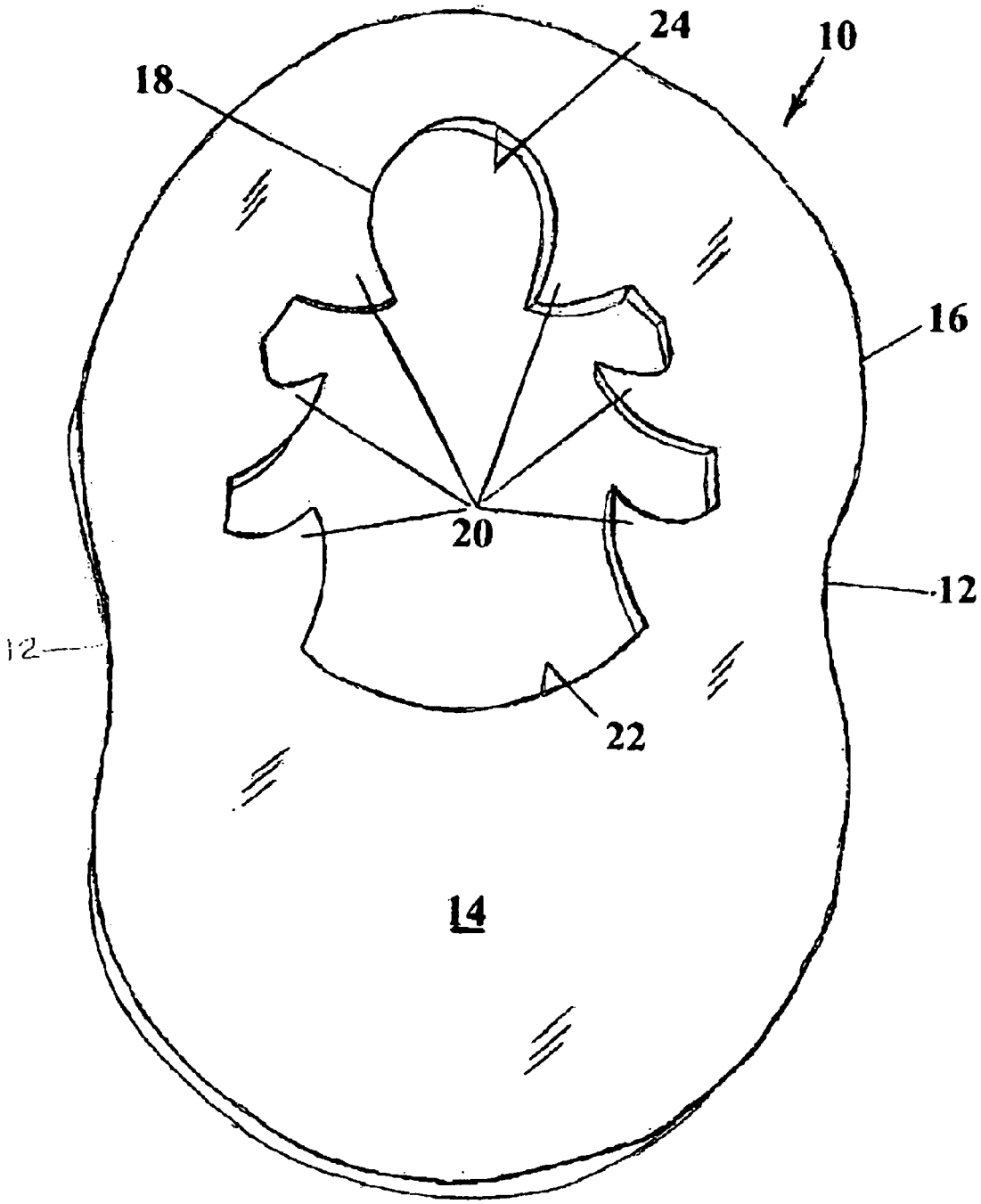
FIG. 2 is a perspective plan view of a first embodiment visor, as cut-out from a sheet of nylon coated rubber.

Referring to FIGS. 1 and 2, a visor 10 has a planar ovoid shape with slightly recessed mid-portions 12, of sheet neoprene with a nylon face reinforcement, with a visor brim or peak portion 14 and an adjoining crown portion 16. The crown portion 16 has a recess 18 of significant area substantially centrally located therein. The recess 18 is characterized by a series of tooth-like inward projections 20, being six in number in the illustrated embodiment.

The two "forward" teeth 20 adjacent the peak portion 14 are joined by a large radius curve 22 that forms the inner boundary of the visor front portion.

The opposed pair of "rear" teeth 20 are joined by a short radius curve 24.

The visor 10 is shown on a strapless, visorless sports helmet 26, the location of the front edge or brim of the helmet 26 being indicated by dashed line 27, wherein the tooth projections 20 of the visor 10 project upwardly in a fashion reminiscent of a shark fin.

The visor may be cut having dimensions approximately 30 cm front to back, and 22 cm at its widest point.

Figure 3:
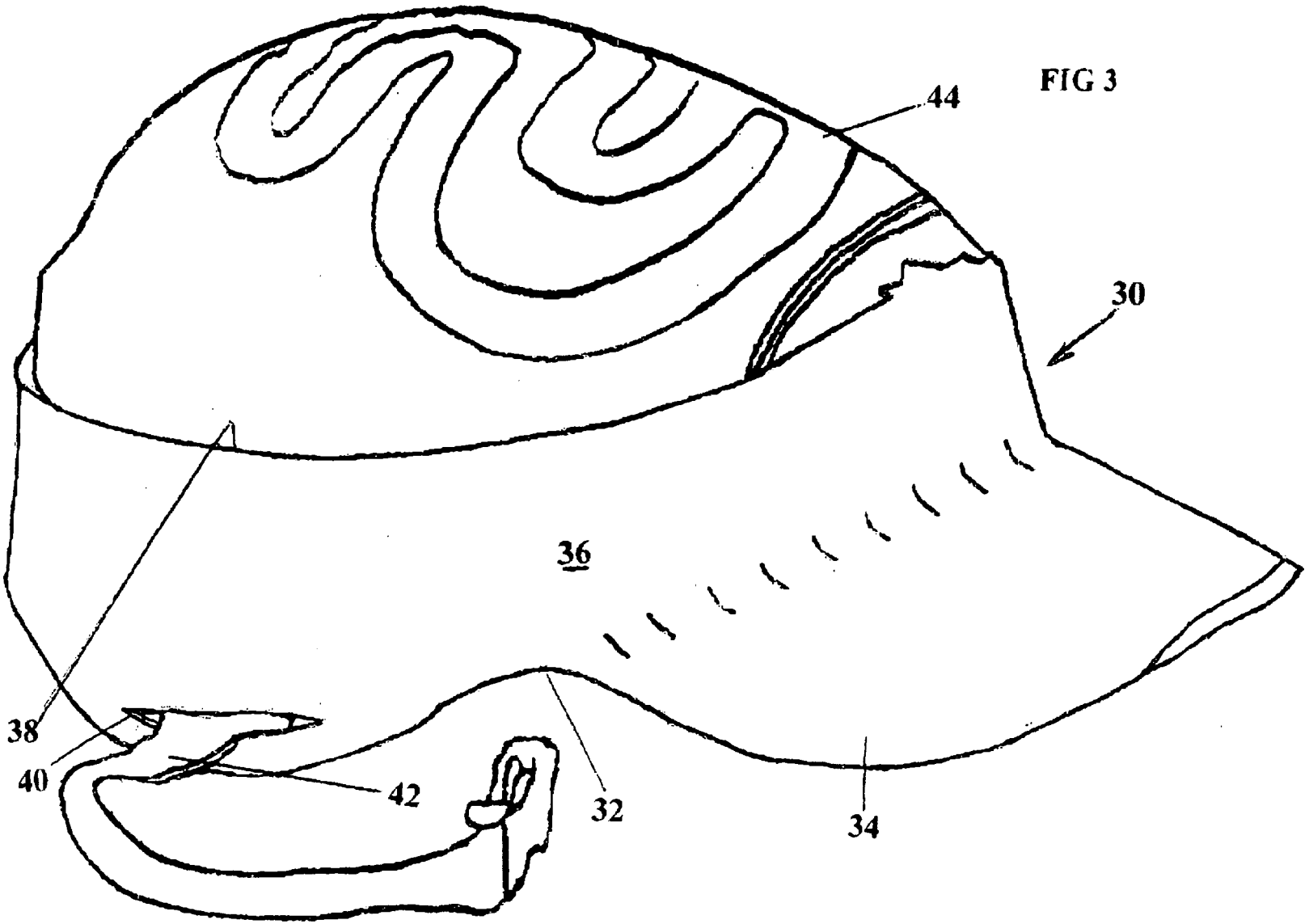
FIG. 3 is a like view of a second embodiment of visor mounted on a sports safety helmet incorporating safety straps.
Figure 4:
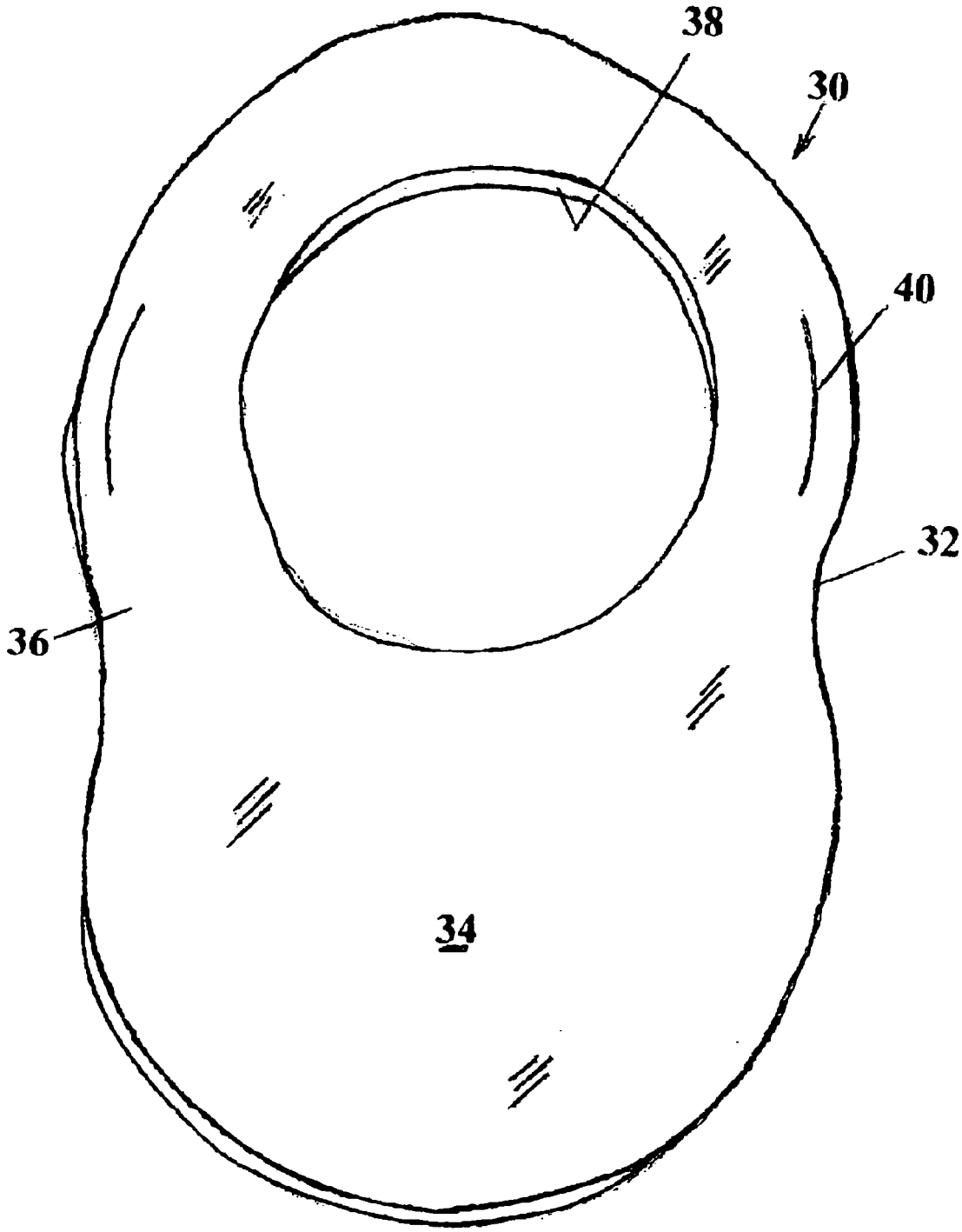
FIG. 4 is a view similar to FIG. 2 of a second embodiment cut-out.

Turning to FIGS. 3 and 4, the ovoid shape of a second visor embodiment 30, with slightly recessed mid-portions 32, has a peak portion 34 and an adjoining crown portion 36. A centrally located crown recess 38 is substantially circular in shape. Slits 40, 40 provide accommodation for the straps 42 of a helmet 44. It will be evident that a wide range of variations and decoration can be introduced without impairing the effectiveness and advantages of the subject visor.

Figure 5:
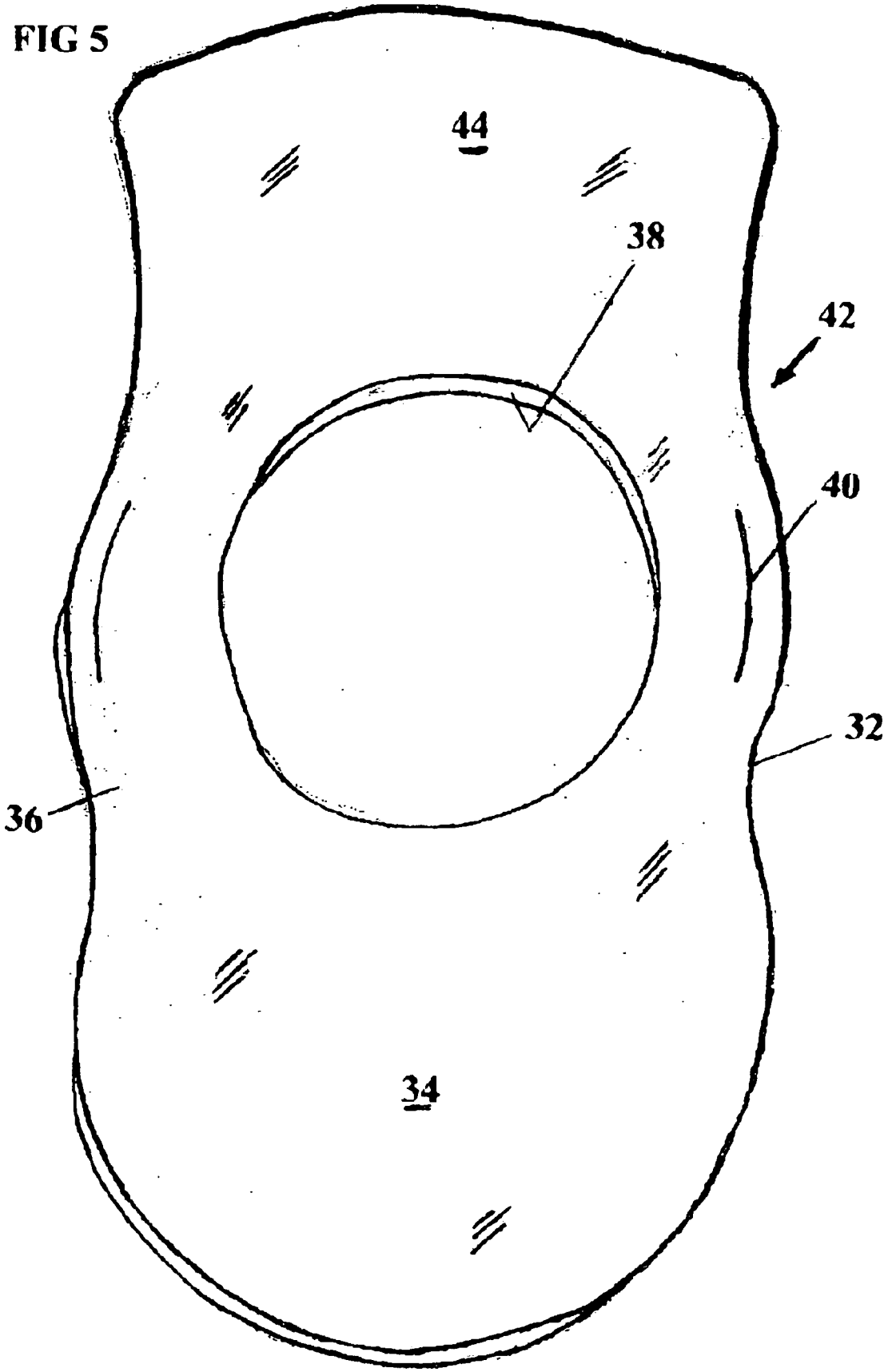
FIG. 5 is a view similar to FIG. 4 of an embodiment incorporating a neck flap.

Referring to FIG. 5, the shape of the visor cut-out 42 has been modified from that of FIG. 4 by the inclusion of a neck-flap portion 44.

When the visor 42 is installed on a helmet, the conformation of the visor crown recess 38 to the rear surface of the helmet serves to direct the neck-flap portion 44 downwardly, in shielding relation with the neck of a wearer.

What is claimed is:

1. A removable elastic visor in combination with a protective helmet, for shielding the visage and eyes of a user, said visor consisting of a unitary elastic sheet including a reinforcing face-layer of elastic fabric, said sheet having a frontal, peak portion and an adjoin crown portion; said crown portion having a substantially symmetrically located crown aperture, wherein, upon application of the crown aperture in tensioned relation over said helmet, within a predetermined range of sizes, said peak portion assumes an outwardly projecting, downwardly concave visor form.

2. The combination as set forth in claim 1, wherein said elastic fabric is of synthetic fibre.

3. The combination as set forth in claim 2, wherein said synthetic fibre is nylon.

4. The combination as set forth in claim 1, wherein said elastic sheet includes neoprene rubber.

5. The combination as set forth in claim 1, including an extended neck-flap portion extending from said crown portion oppositely of said peak portion.

6. The combination as set forth in claim 4, wherein said elastic sheet is of sufficient stiffness, in use, to maintain said peak portion in a substantially semi-tubular configuration.

7. The combination as set forth in claim 6, wherein said elastic sheet has a thickness in the range three to seven millimeters.

8. The combination as set forth in claim 4, wherein said crown portion has a pair of slits located laterally on opposite sides of said crown aperture at a location substantially midway of the crown aperture said slits extending substantially parallel with portions of said crown aperture, in use to receive safety straps in inserted relation therein.

9. The combination as set forth in claim 4, wherein said crown aperture has a decoratively profiled inner edge, including at least one projection extending inwardly of said crown ate.

10. The combination as set forth in claim 9, wherein said crown aperture has a plurality of pointed teeth extending inwardly of said crown aperture.

11. The combination as set forth in claim 1, wherein said elastic visor is self-adhering to said helmet.

12. The combination as set forth in claim 1, said downwardly concave visor form having a curved outer edge; wherein said outer edge requires the application of force thereagainst in order to cause substantial deflection.

* * * * *